United States Patent [19]

Holmes, Jr.

[11] 4,410,288

[45] Oct. 18, 1983

[54] VERTICAL REPLACEMENT DAISY WHEEL ELEMENT

[76] Inventor: Lawrence Holmes, Jr., 91 Highwood Ave., Midland Park, N.J. 07432

[21] Appl. No.: 330,482

[22] Filed: Dec. 14, 1981

[51] Int. Cl.[3] ..... B41J 1/30

[52] U.S. Cl. ..... 400/144.2; 400/175

[58] Field of Search ..... 400/144.2, 144.3, 174, 400/175; 101/93.17–93.19

[56] References Cited

U.S. PATENT DOCUMENTS

| | | | |
|---|---|---|---|
| 3,991,873 | 11/1976 | Paulson et al. | 400/175 X |
| 4,245,916 | 1/1981 | Habich et al. | 400/175 X |
| 4,314,770 | 2/1982 | Harre | 400/175 |

*Primary Examiner*—Paul T. Sewell

*Attorney, Agent, or Firm*—Joseph L. Strabala

[57] ABSTRACT

A daisy wheel print element includes a hub unit which can be fixedly assembled on the shaft of a drive motor and a flat disc element which is assembled with the hub unit in an arrangement which allows the disc element to be inserted on and removed from the hub unit normal to the axis of the shaft of the drive motor. Very little space is required to insert or remove the disc element, which includes opposing guide members that are slidably received on opposite edges of a guide plate of the hub unit and a key or index lug which registers in a notch in the guide plate, as the projecting cylindrical nipple at the center of the disc element nests in the semi-circular cup of the hub unit. Opposing spring prongs bear against the circular periphery of the projecting nipple of the disc element driving it into tight registry with the cup of the hub unit, whereby each disc element assembled with the hub unit will have perfect registry therewith and there will be no relative movement between the hub unit and the disc element when so assembled.

3 Claims, 5 Drawing Figures

FIG _ 1
(PRIOR ART)
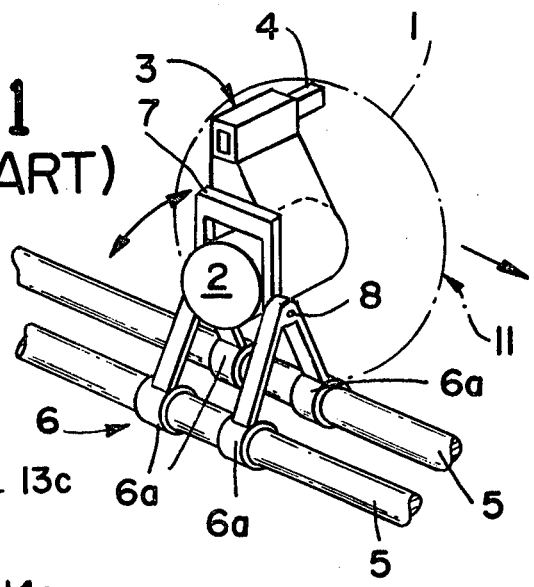
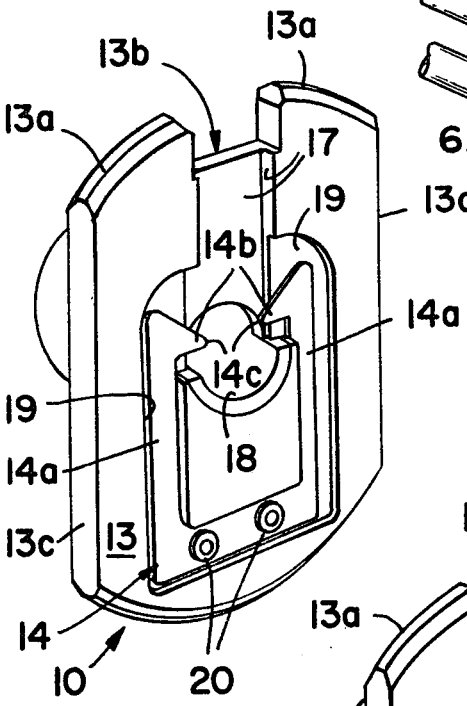
FIG _ 4
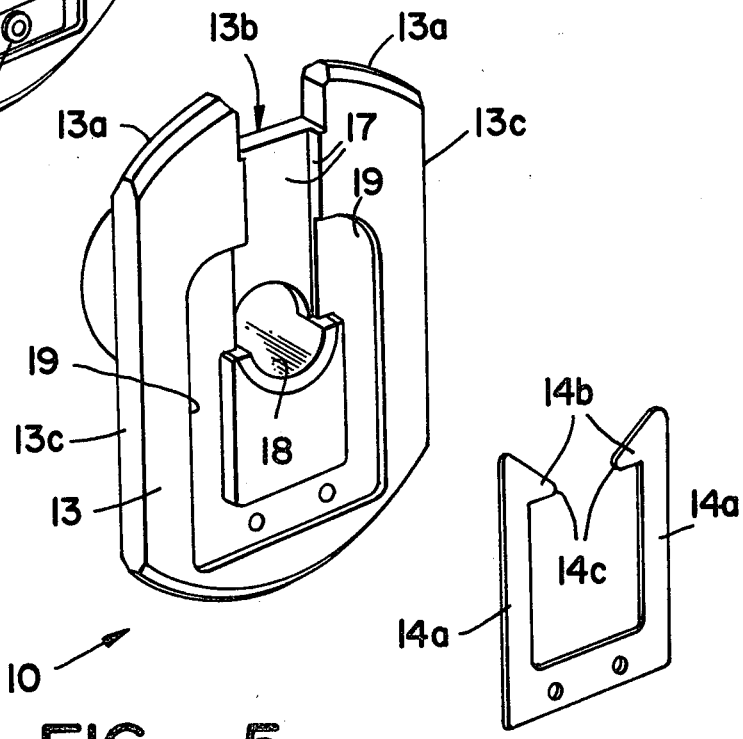
FIG _ 5

VERTICAL REPLACEMENT DAISY WHEEL ELEMENT

BACKGROUND

A class of letter quality printers have been developed which are commonly referred to as daisy wheel printers. Two of the better known of these types of printers are the Diablo and Qume printers.

Common to this type of printer is a circular print wheel which is constructed with a plurality of radial projecting spokes, usually about 100 spokes, each of which spokes has a raised character font on its distal end. If such print wheel is rotated next to a platen of a typewriter and a hammer impacts on the face of the spoke on the side opposite of the font, the latter will be driven toward the platen so that font will be impressed against the platen. With a ribbon and paper located between the font and the platen, printing of a character will be accomplished when the hammer impacts on the distal end of a spoke. Because the ends of the spokes are distorted out of the radial plane of the disc element as the hammer impacts, these wheels are called daisy wheels by analogy to the petals of the flower, commonly referred to as a daisy having radial extending petals.

Typically these daisy wheels are of a unitized construction having a hub to which the spokes are attached and from which they radiate. In the hub of a typical wheel is a bore in which the shaft of a drive motor can be received. Also a notch or some other indexing means is formed in the hub structure so that an indexing pin associated with the motor shaft will be received therein, ensuring the proper angular registry or correspondence between the shaft and the spokes of the print wheel.

Digital logic controls the rotation of the motor shaft and the timing for the imacts of the hammer. To enable the replacement of the print wheel in these machines, the motor and hammer assembly is usually mounted on a carriage which pivots away from the platen of the typewriter (See FIG. 1) so the print wheel can be removed axially from the end of the motor shaft since the wheel must be very close to the platen during printing so the deflection of the spokes will be minimal, when the hammer impacts thereon.

Normally the motor shaft will extend into the hub of the print wheel about ½-inch to properly stabilize it so it will rotate without wobble or flutter. Thus considerable space is required to replace the print wheels in these type of printers and it is necessary to pivot the carriage to withdraw the print wheel from its position adjacent to the platen to enable replacement thereof.

The current invention is an improved print wheel which can be inserted or removed vertically, i.e., normal to the axis of the motor shaft, whereby the carriage mechanisms can be greatly simplified in these types of printers since the motor and hammer assembly does not have to be pivoted to change wheels.

SUMMARY OF THE INVENTION

The improved daisy wheel print element includes a hub unit with a rectangular guide plate and a flat disc element with opposed guide members that are slidably received on the opposite sides of the guide plate and a key or index lug which is received in a notch in the guide plate, along with a circular nipple projecting axially from the disc element which is received in a semi-circular cup in the center of the hub unit with spring means in the hub unit arranged to drive the nipple tightly into the cup for proper registry between the hub unit and disc element.

Generally the semi-circular cup receives the nipple in a precision fit and the nipple is spring-loaded against the cup to ensure perfect registry between the hub unit and disc element by forcing the nipple into the cup. By overcoming the spring-load the disc element can be removed from the guide plate, in a direction normal to the motor shaft.

With this arrangement the disc element can be changed quickly and conveniently either to change the character font or to replace a defective disc element.

It is an object of this invention to provide a more cost effective print wheel for daisy wheel-type printers.

It is also an object to provide an improved daisy wheel which will simplify the construction of daisy wheel printers.

Other objects of the invention include the ability to change daisy wheel print elements without removing ribbon and greatly simplified installation and removal procedures for the operator of these types of printers.

Also an object of the invention is to eliminate costly pivoting structures, now necessary to replace the conventional daisy wheel print wheels now available.

BRIEF DESCRIPTION OF THE DRAWINGS

FIG. 1 is a perspective of print mechanism of a daisy wheel printer with parts shown in phantom showing the typical arrangement currently in use;

FIG. 4 is a perspective of the outer face of the hub unit shown in FIG. 2; and, FIG. 5 is an exploded view of the hub unit in perspective.

DESCRIPTION OF A PREFERRED EMBODIMENT

Figure 2:
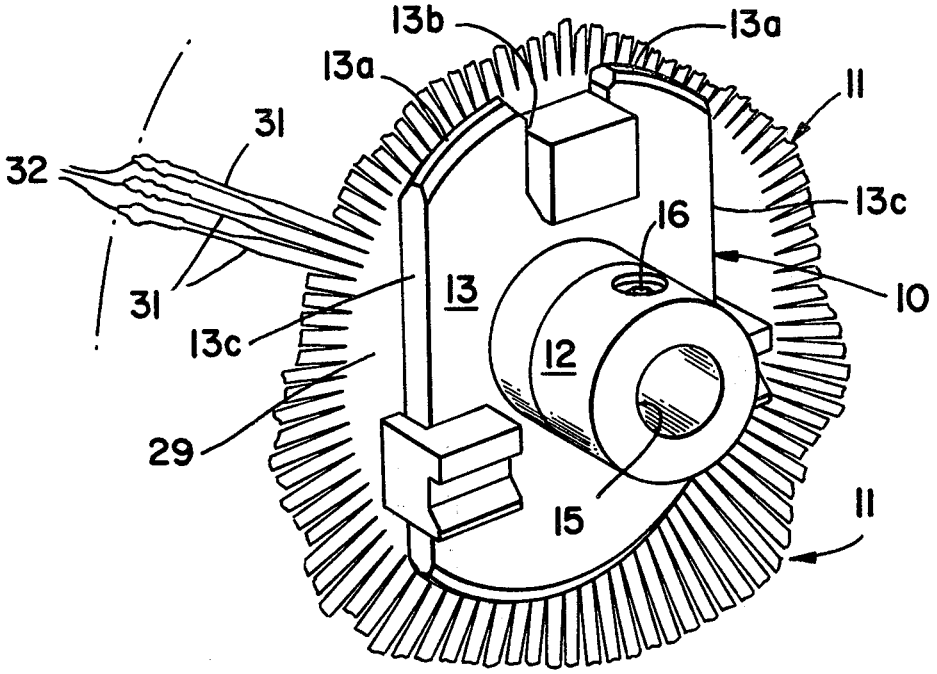
FIG. 2 is a perspective of the new daisy wheel print element showing the disc element assembled with the hub unit.

FIG. 1 is a perspective of a portion of a print mechanism of a conventional daisy wheel printer with parts shown in phantom showing the typical arrangement currently in use.

Viewing FIG. 1 the conventional print wheel 1 is shown in phantom and it is supported on the shaft (not shown) of motor 2. In turn the motor has attached thereto the hammer unit 3 whose impact element 4 is controlled by logic to drive the spokes of the print wheel toward the platen (not shown) to effect printing. Two guide bars 5 support a carriage 6 which includes four guides *6a* that slide axially along the bars. Included in the carriage is a U-frame member 7 which supports the motor and a hammer unit and itself it supported in the carriage on pivots 8. This arrangement allows the U-frame to rock toward and away (indicated by arrows 9) from the platen (now shown) to provide space for the removal of a conventional daisy print wheel.

In FIG. 2 it can be seen the new print wheel has two principal parts, which are the hub unit 10 and the disc element 11. The disc element mates with the hub unit, the latter of which is specially constructed to received the disc element in a manner to achieve perfect registration.

Constructed of three main parts, the hub unit includes, a hub 12, and guide plate 13 and a C-shaped clip spring. Formed concentrically in the hub is a bore 15 which is adapted to be received on the shaft of the drive motor (see FIG. 2) and a set screw 16 or other locking arrangement is used to mount the hub unit on the motor shaft in a semi-permanent manner. A key slot (not shown) can be used in the bore to ensure proper angular registry of the hub unit on the motor shaft. Since the disc element 11 can only be assembled one way on the hub unit, once the hub unit is locked to the motor shaft in proper alignment for the control logic, any disc element subsequently installed will be in correct registry.

Referring to FIG. 5, the details of the arrangements for achieving precision registry between the disc element 11 and the hub unit 10 can be better understood. Looking at the outer face of the guide plate 13 it can be seen it is relieved from one edge of the center with a groove 17, with width of this groove being only slightly greater than the outer diameter of the nipple 30 on the disc element 11. The depth of this groove equal to the raised height of the nipple. As the groove only goes to the center of the hub unit, it leaves a semi-circular cup 18 formed thereat because of the central bore in the hub in which the nipple will nest.

Also formed in the face of the guide plate is a second D-shaped groove which is about ½ the depth of groove 17. This D-shaped groove receives the C-shaped spring 14 which is secured therein with rivets 20, best shown in FIG. 4. In this same drawing it can also be seen that the D-shaped groove is oversized in respect to the dimensions of the C-shaped spring. Because this spring is secured in its central portion, the two legs **14*a* thereof form distortable prongs having inwardly projecting ears 14*b*. These ears are tapered so they have a wedge shape and also have rounded noses 14*c* which oppose each other. The distance between the two noses is less than the outer diameter of nipple 30 and as a result, as the nipple travels down the groove or track 17 it will force these prongs apart due to the tapered outer edges of the tabs to allow the nipple to seat in the cup 18**. When the latter occurs the resilient prongs will force the rounded noses against the outer periphery of the nipple above semi-circular cup, driving the nipple tightly into the cup. This insures the disc element will be perfectly concentric with the shaft of the drive motor when so assembled.

The hub unit 10 can be a single molded element (less the C-shaped spring) or be made several parts as shown in the drawings. Hub 12 could be fabricated of metal and assembled with a plastic guide plate 13 thereafter. In any case it is a precision part. The guide plate has at least one rounded or bevelled edge **13*a* which includes a notch 13*b* which registers with the groove or track 17** therein, described above. This rounded or bevelled edge facilitates the assembly of the disc element on the guide plate when these parts are put together.

Figure 3:
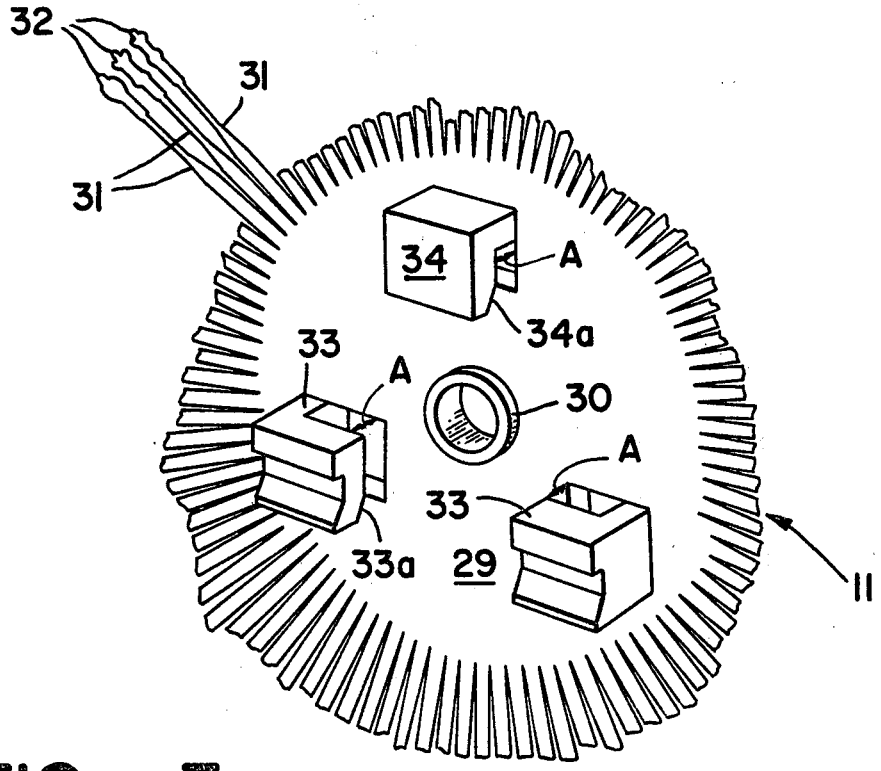
FIG. 3 is a perspective of the back face of the disc element shown in FIG. 2.

The disc element 11 includes a flat circular central portion 29 which has a nipple 30 projecting from its center, best shown in FIG. 3. Radiating from this central portion are a plurality of spokes 31 which have impact pads 32 at their distal ends. On the opposite face of the impact pads, which are struck by the hammer to effect printing, are the individual character font. Normally the spokes are tapered to reduce their cross section thus reducing the energy necessary to effect printing.

On the rear face (i.e., the face without the fonts) of the disc element 11, on the central portion 29 thereof, are two guide lugs, 33, which oppose one another, and an indexing lug 34 arranged in a triangular pattern. Each lug is L-shaped leaving a clearance "A" between its overhanging portion and the top plane of the rear face of the disc element, which approximates the thickness of the guide plate. See FIG. 3 best illustrating this feature.

With the aforesaid structures it can be appreciated the disc element 11 can be assembled on the hub unit by sliding the guide lugs 33 onto the opposite edges **13*c* of the guide plate 13 (see FIG. 2) and forcing this element down until the index lug 34 is received in notch 13*b* of the guide plate. As can have seen in the drawings the several lugs are bevelled on their leading edges 33*a* and 34*a*, respectively, and thus, if the clearance "A" is slightly less than the thickness of the guide plate 13**, these lugs will "grip" the guide plate when assembled thereon, being slightly distorted as the assembly occurs. With this three point attachment, it eliminates all wobble and flutter between the disc element and the hub unit.

It must be appreciated that when the index lug 34 is progressing into notch **13*b* of the guide plate 13, the nipple 30 is simultaneously tracking down groove 17 on the outer face of the guide plate, forcing the prongs 14*a* apart. The prongs spring back after maximum diameter of the nipple passes by the opposing noses 14*c* thereof, causing the rounded nose of each prong to move inwardly and bear against the circular periphery of the nipple, driving it tightly into the semi-circular cup 18** for perfect concentric registry.

It must be appreciated the assemblies described can be made of metal or plastics, and that the principals of the invention can be incorporated modified structures without departing from functions and operative effects thereof.

Also, it is within the contemplation of this invention that the semi-circular cup 18 could be formed on the dis element 11 and the nipple 30 could be formed on the hub unit 10 with the spring clip 14 on the former. This is merely a reversal of the parts employed to achieve perfect and exacting registry between the several components.

Having described my invention, I claim:

1. A hub unit for daisy wheel-type print element with vertical replaceable disc elements comprising a circular hub means with a bore therein and a guide plate means fixedly mounted on said hub means normal to the axis of such bore, said resulting assembly having formed therein a semi-circular cup means concentric with said bore; and spring means mounted on said guide plate means operable to apply spring pressure on a circular nipple received in said semi-circular cup means to force it into said cup means for concentric registry, said spring means being a C-shaped spring with a pair of arms forming prongs with inwardly directed ears operable to bear on a circular surface of a nipple received in said semi-circular cup means to force such a nipple into said cup means.

2. The hub unit defined in claim 1 wherein the resulting assembly includes a groove means in the face of the guide plate means operable to form a track for a circular nipple to move to the semi-circular cup, said groove means terminating at the center of the bore forming the semi-circular cup means.

3. A daisy wheel print unit which allows the disc element with the individual character font to be removed normal to the axis of the shaft driving the print unit comprising:

a hub means with a bore therein for assembly on a rotating shaft, said hub means having a disc element guide plate means fixedly mounted thereon normal to the axis of such bore and a semi-circular cup means formed therein being concentric with said bore;

a flat disc element having a central circular disc portion with a plurality of spokes extending radially therefrom, each of said spokes having a character font on one face and an impact pad on the opposite face at its distal end said disc element having a raised circular nipple concentrically extending from said central circular disc portion, said disc element also having guide means located on said central circular disc portion operable to be received on the guide plate means of said hub means normal to the rotational axis of the hub to prevent relative rotation therebetween when said disc element is slidably received on said guide plate means with said circular nipple simultaneously received in said cup means; and spring means mounted on said hub means, said spring means having a C-shaped configuration with a pair of opposed arms forming prongs with inwardly directed ears operable to bear on the outer circular surface of said nipple means received in said semi-circular cup means to force said nipple means into said cup means for concentric registry between the hub means and the disc element.

* * * * *